US012325988B2

(12) United States Patent
Blum

(10) Patent No.: US 12,325,988 B2
(45) Date of Patent: Jun. 10, 2025

(54) AERATOR

(71) Applicant: Neoperl GmbH, Müllheim (DE)

(72) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 382 days.

(21) Appl. No.: 17/784,185

(22) PCT Filed: Dec. 17, 2020

(86) PCT No.: PCT/EP2020/086890
§ 371 (c)(1),
(2) Date: Jun. 10, 2022

(87) PCT Pub. No.: WO2021/123065
PCT Pub. Date: Jun. 24, 2021

(65) Prior Publication Data

US 2023/0023918 A1 Jan. 26, 2023

(30) Foreign Application Priority Data

Dec. 19, 2019 (DE) ..... 202019107100.1

(51) Int. Cl.
*E03C 1/08* (2006.01)
*E03C 1/084* (2006.01)

(52) U.S. Cl.
CPC ..... *E03C 1/084* (2013.01)

(58) Field of Classification Search
CPC ..... E03C 1/084
See application file for complete search history.

(56) References Cited

U.S. PATENT DOCUMENTS 4,779,803 A * 10/1988 Corsette ..... B05B 7/005 239/504
4,921,599 A 5/1990 Botsch
5,476,588 A * 12/1995 Nagaoka ..... B01D 29/012 29/896.62
5,678,765 A * 10/1997 Dobbs ..... B05B 11/0005 239/512

FOREIGN PATENT DOCUMENTS

CN 1092335 C 10/2002
CN 1722039 A 1/2006
CN 101340961 B 6/2011
CN 102359154 B 3/2013
CN 105951936 A 9/2016
(Continued)

*Primary Examiner* — Qingzhang Zhou
(74) *Attorney, Agent, or Firm* — Volpe Koenig

(57) ABSTRACT

A jet regulator (1) which can be mounted on the water outlet of a sanitary outlet fitting and has a jet regulator housing (2), in which a jet splitter (3) is provided, which has splitter openings (17) for dividing the water flowing through into individual jets, and at least one insert part (5), which has a grid structure (6) consisting of two sets of parallel webs (7; 8) which touch one another or intersect at crossing nodes (9). In the jet regulator (1), the sets are arranged in two levels offset in the longitudinal direction of the jet regulator; the mutually parallel webs (7) of an inflow side set have a round or rounded web cross-section, and the webs (8) of an outflow side set have a flattened portion (10) on their inflow side and are rounded on their outflow side (11).

19 Claims, 2 Drawing Sheets

(56) References Cited

FOREIGN PATENT DOCUMENTS

| | | | |
|---|---|---|---|
| CN | 106545062 | B | 2/2019 |
| DE | 20215273 | | 4/2004 |
| DE | 112011104659 | | 10/2013 |
| DE | 112011104661 | | 10/2013 |
| DE | 102006062986 | | 9/2015 |
| DE | 202015001886 | | 7/2016 |
| EP | 1616999 | | 1/2006 |
| IT | UB20154198 | A1 | 4/2017 |
| JP | 2002275969 | A | 9/2002 |
| WO | 9506787 | | 3/1995 |
| WO | 2017045761 | | 3/2017 |

* cited by examiner

AERATOR

TECHNICAL FIELD

The invention relates to a jet regulator which can be mounted on the water outlet of a sanitary outlet fitting, having a jet regulator housing in which there is provided a jet splitter, which has splitter openings for dividing the water flowing through into individual jets, and having at least one insert part which has a grid structure comprised of two sets of parallel webs that touch or intersect one another at crossing points.

BACKGROUND

Jet regulators are already known in various designs. They are mounted on the water outlet of a sanitary outlet fitting in order to form the emerging water into a homogeneous, non-sputtering and optionally also sparkling-soft outlet jet, i.e. one that is mixed with ambient air.

A jet regulator of the type mentioned at the outset has thus also already been provided, said jet regulator having a cartridge-shaped jet regulator housing which can be inserted into a sleeve-shaped outlet nozzle from the inflow side up to an insertion stop, which outlet nozzle bears a connection thread on the inside or outside of its sleeve circumference, which can be screwed to a mating thread on the water outlet of the sanitary outlet fitting (cf. DE 202 15 273 U1). The previously known jet regulator has an upstream screen on the inflow-side end face of its jet regulator housing, which upstream screen has to filter out the dirt particles or limescale residue that may be carried along in the inflowing water. In the housing interior of the jet regulator housing there is provided a jet splitter having splitter openings, which divide the water flowing through the housing into individual jets. According to Bernoulli's principle, on the outflow side of the jet splitter there is generated a negative pressure which can be utilized, as required and given a corresponding configuration of the jet regulator housing, to draw ambient air into the housing interior. Behind the jet splitter in the flow direction, insert parts are inserted in the jet regulator housing, each of which has a grid or mesh structure composed of webs crossing one another at crossing nodes, the webs of each one of these insert parts being arranged in a common plane running transversely to the throughflow direction. The outflow-side end face of the previously known jet regulator is formed by a flow straightener having a multiplicity of guide openings, each of which can have a longitudinal extent greater than the clear diameter of these guide openings.

In order to be able to more strongly decelerate the individual jets emerging from the jet splitter as required, and to promote the mixing of these individual jets with the ambient air that is drawn in, it can be expedient if a screen disk made of a fine metal braided fabric is inserted in the jet regulator housing in the previously known jet regulator between the jet splitter and the inflow-side first insert part (cf. FIGS. 11-12 in DE 202 15 273 U1). While the insert parts and the other constituent parts of the previously known jet regulator are produced in the form of plastic injection-molded parts, the screen disks are laboriously braided from a thin metal wire. However, the production of such screen disks is associated with comparatively high complexity and the material variety of these screen disks compared to the other plastic constituent parts of the previously known jet regulator can cause additional problems when such jet regulators are recycled. Furthermore, the in particular automated mounting of such jet regulators becomes more difficult because the screen disks can easily become caught in one another owing to the wire ends protruding at the peripheral edge.

SUMMARY

There is therefore in particular the problem of providing a jet regulator of the type mentioned at the outset, in which the structures in the jet regulator housing that are intended to decelerate the individual jets and optionally also to mix them with the air in an improved way can be produced and mounted with low outlay.

In the case of the jet regulator of the type mentioned at the outset, the solution according to the invention to this problem provides, in particular, that the sets are arranged in two planes offset in the longitudinal direction of the jet regulator, in that the mutually parallel webs of an inflow-side set have a round or rounded web cross section, and in that the webs of an outflow-side set bear a flattened portion on their inflow side and are rounded on their outflow side.

The jet regulator according to the invention can also be mounted on the water outlet of a sanitary outlet fitting in order to form the water emerging there into a homogeneous and non-sputtering outlet jet. For this purpose, the jet regulator according to the invention has a jet regulator housing in which there is provided a jet splitter having splitter openings, which has to divide the water flowing through the jet splitter into a plurality of individual jets. In order to be able to strongly decelerate the individual jets generated in the jet splitter and, as required, to improve the turbulence and mixing of these individual jets with ambient air, at least one insert part having a grid structure composed of two sets of parallel webs, which touch one another or intersect at crossing nodes, is inserted in the jet regulator housing of the jet regulator according to the invention. In order to be able to give a finely structured or a fine-mesh configuration to the grid structure of this at least one insert part, as was possible to date using screen disks, provision is made according to the invention that the web sets are arranged in two planes offset in the longitudinal direction of the jet regulator. Since the webs arranged in the various planes are supported against one another, the webs provided in the individual planes can also have comparatively thin configurations. Since the mutually parallel webs of an inflow-side set have a round or rounded web cross section, the outflowing water is initially conducted readily into the grid structure, formed by the various webs, of the at least one insert part, without the homogeneity of the water emerging from the jet regulator according to the invention being excessively adversely affected. The water then enters the region of the outflow-side-arranged set of webs of this at least one insert part. Since these webs arranged on the outflow side bear a flattened portion on their inflow side, strong deceleration of the water is promoted even if these webs have a comparatively small diameter. Since these webs are rounded on their outflow side, a homogeneous emergence of the water flowing through is promoted. Since the at least one insert part may also be produced as a plastic injection-molded part, for example, and does not have to be produced from a metal screen even in the case of a filigree grid structure, the production of the jet regulator according to the invention and, if appropriate, also later recycling of its constituent parts is possible easily and inexpensively. Due to the homogeneous structure of the at least one insert part, the mounting of the jet regulator according to the invention and the insertion of the insert part into its jet regulator housing are also made significantly easier.

In order to promote the deceleration of the water flowing onto the at least one insert part and to promote the turbulence of the water flowing through the insert part, it is expedient if the flattened portions of the webs provided in the outflow-side set and their rounded outflow sides are connected by way of web walls arranged parallel to one another in the throughflow direction. Since the flattened portion of the webs provided in the outflow-side set, on the one hand, and their rounded outflow side, on the other hand, are connected by way of web walls arranged parallel to one another, the transition between the flattened portion of these webs and the web wall oriented in the throughflow direction may be formed with sharp edges, which promotes the deceleration action of this grid structure.

It can be advantageous in this respect if the flattened portion of the webs provided in the outflow-side set forms a respective right angle with the web walls adjoining it on either side.

In order not to excessively adversely affect the homogeneity of the emerging water, without reducing the deceleration action of the grid structure provided in the at least one insert part, it is advantageous if the web walls have a longitudinal extent in the throughflow direction that is greater than the diameter of the outflow-side rounding.

In order to give the at least one insert part of the jet regulator according to the invention a sufficiently stable configuration even with a comparatively filigree grid structure, without causing this insert part to sag excessively even at high incident-flow pressures, it is advantageous if the webs that cross one another are connected to one another in one piece and if the webs touch one another at their crossing nodes in such a way that the flattened portion of the webs provided in the outflow-side set is arranged approximately in the longitudinal center plane of the webs forming the inflow-side set.

Such an embodiment of the jet regulator according to the invention can be produced especially easily if the tool parting plane of the injection molding tool used to produce the at least one insert part is arranged approximately in the plane defined by the flattened portion. In this context, the grid structure can be easily formed in the at least one insert part in that one of the two tool halves of the injection molding tool used forms a flat surface, while the profiles of the webs are shaped by recesses in the other tool half. This has the advantage that the two tool halves no longer have to be aligned with respect to one another with the same accuracy, since the problem that the two half-shells forming the overall profile of a web could be offset with respect to one another transversely to the tool parting direction is avoided.

In order to counteract the grid structures of different stored insert parts becoming caught in one another, it may be advantageous if the grid structure of the at least one insert part is bounded by an outer ring, and if the web ends of the webs forming this grid structure are molded on the inner circumference of the outer ring.

Easy and inexpensive production of the at least one insert part used in the jet regulator according to the invention is promoted if the at least one insert part is produced in the form of a plastic injection-molded part.

For the reasons already mentioned above, it is advantageous if the flattened portion of the webs provided in the outflow-side set defines a tool parting plane of an injection molding tool used to produce the at least one insert part.

It has been shown that the deceleration action can be promoted and the turbulence of the water flowing through can be improved if preferably at least two such insert parts are connected downstream of the jet splitter of the jet regulator according to the invention in the throughflow direction.

One embodiment according to the invention, which can be used advantageously in the low-pressure range in particular, provides that the jet splitter is in the form of a diffuser which has a cup-shaped diffuser insert, the cup base of which is in the form of an impinging and deflecting surface for the inflowing water and which, on the circumferential wall of its cup shape, has splitter openings which are spaced apart from one another in the circumferential direction and lead into an annular gap. The water flowing to this jet splitter is thus deflected at the impinging and deflecting surface of the diffuser insert in the radial direction to the sides of the cup-shaped diffuser insert, in order there to flow through the openings provided on the circumferential wall of the diffuser insert into the annular gap that follows in the flow direction.

In order to generate a negative pressure on the outflow side of the jet splitter, which negative pressure can be utilized as required to draw ambient air into the housing interior of the jet regulator housing, it is advantageous if the annular gap narrows in the throughflow direction.

In this respect, a particularly simple and advantageous embodiment according to the invention provides that the diffuser insert of the jet splitter can be inserted into a diffuser ring and that the annular gap is formed between the diffuser insert and the diffuser ring of the diffuser.

In order to keep the grid structure in the at least one insert part spaced apart from those structures of the jet regulator according to the invention that are connected downstream in the flow direction, it is advantageous if the outflow-side end edge on the outer ring of the at least one insert part is arranged below the plane formed by the grid structure in the throughflow direction. Thus, this outflow-side end edge on the outer ring of the at least one insert part is also used at the same time as a spacer with respect to the insert part that follows in the flow direction or other constituent parts of the jet regulator according to the invention that follow in the flow direction.

The jet regulator according to the invention may be in the form both of an aerated and a non-aerated jet regulator. If the jet regulator according to the invention is to be in the form of an aerated jet regulator, it is advantageous if the jet regulator housing has at least one aeration opening on its housing circumference in a cross-sectional plane arranged directly below the jet splitter, through which aeration opening ambient air can be drawn into the housing interior of the jet regulator housing. In the exemplary embodiment of the jet regulator according to the invention in which it is in the form of a jet aerator, this ambient air is mixed with the water flowing through the jet regulator housing to form a sparkling-soft outlet jet.

In order to support the grid structure, which may also be filigree, of the at least one insert part against the pressure of the inflowing water, it may be advantageous if on the outflow side of the at least one insert part there is provided a central spacer, the outflow-side end face of which, which is preferably arranged approximately in a plane with the outflow-side end face of the outer ring, rests on the grid structure of an insert part that follows in the flow direction.

BRIEF DESCRIPTION OF THE DRAWINGS

Refinements according to the invention will emerge from the following description of an exemplary embodiment according to the invention in conjunction with the claims and the drawing. The invention will be described in more detail below on the basis of a preferred exemplary embodiment.

In the Drawings.

DETAILED DESCRIPTION

Figure 2:
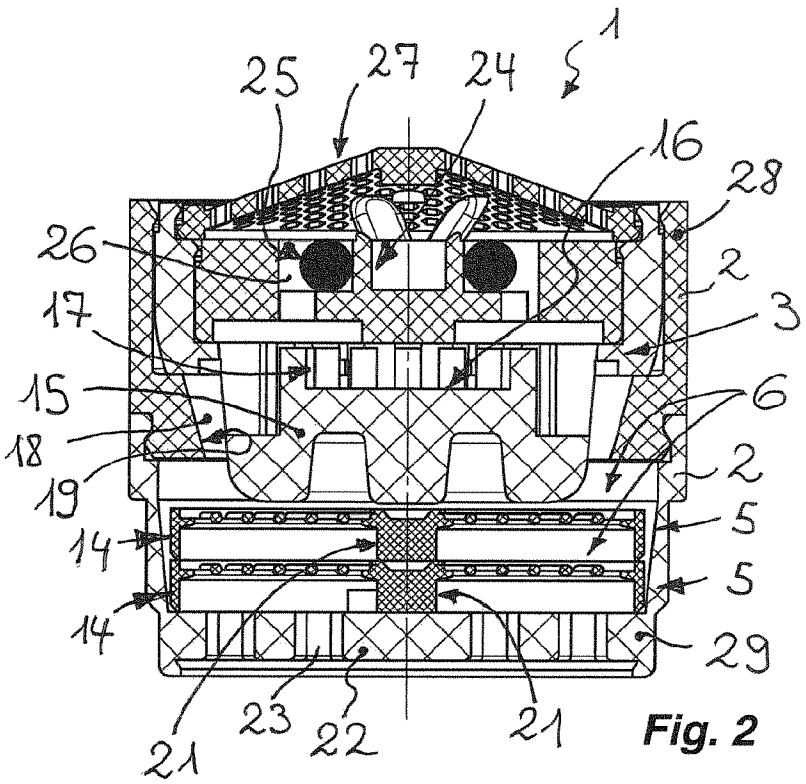
FIG. 2 shows the jet regulator from FIG. 1 in a longitudinal section through the sectional plane II-II from FIG. 1, with at least two insert parts being inserted in the housing interior of the jet regulator housing, each of which has a grid structure composed of two sets of webs crossing one another.
Figure 1:
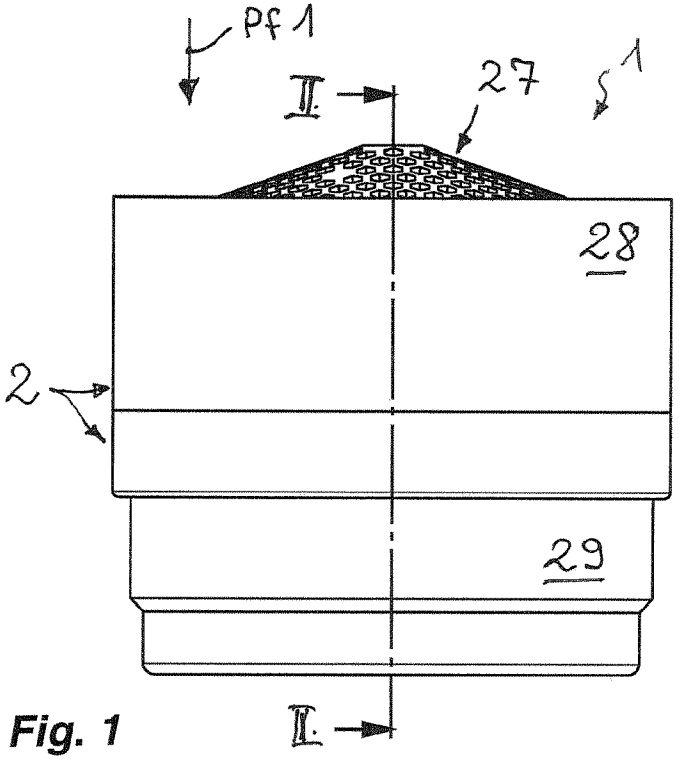
FIG. 1 shows a side view of a jet regulator according to the invention which can also be mounted on the water outlet of a sanitary outlet fitting in order to form the water emerging there into a homogeneous and non-sputtering outlet jet.

A jet regulator 1 is illustrated in FIGS. 1 and 2. The jet regulator 1 is mounted on the water outlet of a sanitary outlet fitting, not shown here in more detail, in order to form the water emerging there into a homogeneous and non-sputtering outlet jet. For this purpose, the jet regulator 1 has a jet regulator housing 2 in which there is provided a jet splitter 3 having splitter openings 17, which has to divide the water flowing through the jet splitter 3 into a plurality of individual jets. In order to be able to very strongly decelerate the individual jets generated in the jet splitter 3 and, as required, to improve the turbulence and mixing of these individual jets with ambient air, at least one insert part 5 having a grid structure 6 composed of two sets of parallel webs 7, 8, which touch one another or intersect at crossing nodes 9, is inserted in the jet regulator housing 2 of the jet regulator 1. In the longitudinal section according to FIG. 2, it can be seen that the jet regulator 1 depicted here has two such insert parts 5 which follow one another in the throughflow direction Pf1.

In order to be able to give a finely structured or a fine-mesh configuration to the grid structure 6 of these insert parts 5, as was possible to date using screen disks of metal braided fabric, provision is made that the web sets formed from the webs 7, 8 are arranged in two planes offset in the longitudinal direction of the jet regulator. Since the webs 7, 8 arranged in the various planes are supported against one another, the webs 7, 8 provided in the individual planes can also have comparatively thin configurations. Since the mutually parallel webs 7 of an inflow-side set have a round or rounded web cross section, the inflowing water is initially conducted readily into the grid structure 6 formed by the various webs 7, 8, without the homogeneity of the water emerging from the jet regulator 1 being excessively adversely affected. The water then enters the jet regulator housing 2 in the region of the outflow-side-arranged set of webs 8 of this at least one insert part 5. Since these webs 8 arranged on the outflow side bear a flattened portion 10 on their inflow side, strong deceleration of the water is promoted even if these webs 8 have a comparatively small diameter. Since the webs 8 are rounded on their outflow side, a homogeneous emergence of the water passing through is substantially promoted. Since the insert parts 5 may also be produced as plastic injection-molded parts and do not have to be produced from a metal screen even in the case of a filigree grid structure, the production of the jet regulator 1 and its insert parts 5 and also later recycling of the constituent parts is possible easily and inexpensively.

Figure 4:
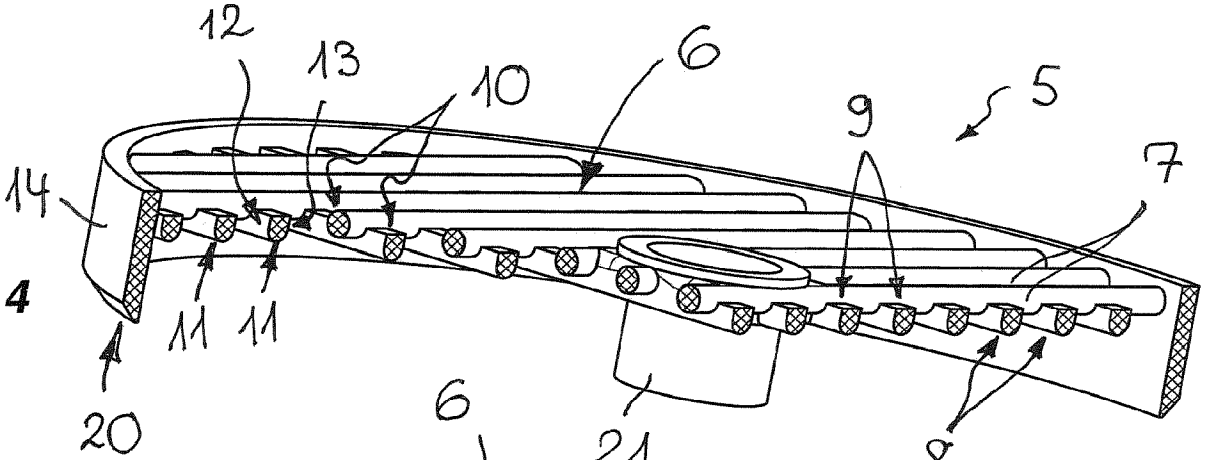
FIG. 4 shows the insert part, which was already shown in FIG. 3 and is shown here in longitudinal section in certain regions, of the jet regulator depicted in FIGS. 1 and 2.

As is clear from a comparison of FIGS. 2 and 4, the flattened portion 10 of the webs 8 provided in the outflow-side set and their rounded outflow side 11 are connected via web walls 12, 13, which are arranged parallel to one another in the throughflow direction Pf1.

In order to be able to give the longitudinal edge of these webs 8 between the inflow-side flattened portion 10, on the one hand, and the adjacent web wall 12 or 13, on the other hand, as sharp-edged a configuration as possible, it is advantageous if the flattened portion of the webs 8 provided in the outflow-side set each forms an approximate respective right angle with the web walls 12, 13 adjoining it on either side.

The longitudinal sections according to FIGS. 2 and 4 clearly show that the web walls 12, 13 have a longitudinal extent in the throughflow direction Pf1 that is greater than the diameter of the rounding provided on the outflow side 11 of the webs 8. The webs 7, 8 that cross one another of each insert part 5 are connected to one another in one piece, with the webs 7, 8 touching one another at their crossing nodes 9 in such a way that the flattened portion 10 of the webs 8 provided in the outflow-side set is arranged approximately in the longitudinal center plane of the webs 7 forming the inflow-side set. In this respect, the webs 7, 8 in the different planes are arranged offset with respect to one another by half the diameter of the webs 7, for example, and the flattened portion 10 is formed, for example, along a secant of an otherwise semi-circular profile or cross section of the webs 8.

Figure 3:
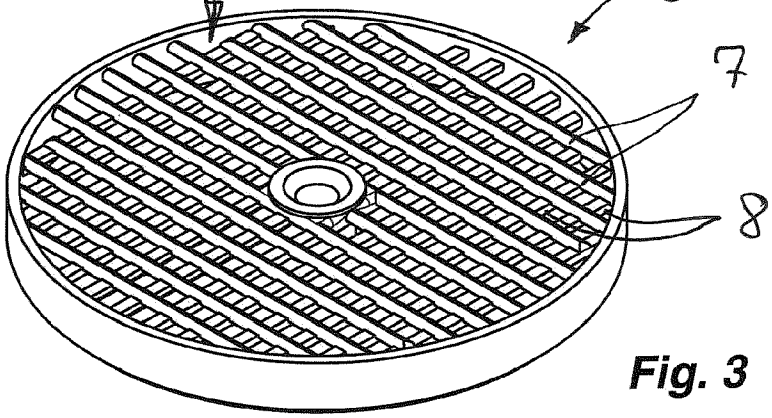
FIG. 3 shows one of the insert parts of the jet regulator shown in FIGS. 1 and 2.

As is clear from FIGS. 3 and 4, the grid structure 6 of the insert parts 5 is bounded by an outer ring 14, the web ends of the webs 7, 8 forming this grid structure 6 being molded on the inner circumference of the outer rings 14. In this respect, the flattened portion 10 of the webs 8 provided in the outflow-side set may also define a tool parting plane of an injection molding tool used to produce the at least one insert part 5. The insert parts 5 and preferably also the other constituent parts of the jet regulator 1 are produced as plastic injection-molded parts.

The jet splitter 3 of the jet regulator 1 may be in the form of a perforated plate which has splitter openings and which is arranged in a plate plane oriented transversely to the throughflow opening Pf1. In the case of the jet regulator 1 illustrated here, however, the jet splitter 3 is in the form of a diffuser which has a cup-shaped diffuser insert 15, the cup base of which is in the form of an impinging and deflecting surface 16 for the inflowing water. On the circumferential wall of its cup shape, this cup-shaped diffuser insert 15 has splitter openings 17 which are spaced apart from one another in the circumferential direction and lead into an annular gap 18. This annular gap 18 narrows in the throughflow direction of the water flowing through, with the result that a negative pressure is generated on the outflow side of this jet splitter 3. The diffuser insert 15 of the jet splitter 3 is inserted in a diffuser ring 19 which delimits the annular gap 18 between itself and the diffuser insert 15.

A comparison of FIGS. 3 and 4 makes it clear that the outflow-side end edge 20 on the insert parts 5 is arranged below the plane formed by the grid structure 6 in the throughflow direction Pf1. This outflow-side end edge 20 thus forms a spacer, which keeps the relevant insert part 5 spaced apart from the insert part 5 that follows in the flow direction or another following constituent part of the jet regulator 1.

The jet regulator 1 may be in the form of an aerated jet regulator, or what is referred to as a jet aerator, which has aeration openings on the housing circumference of its jet regulator housing, through which aeration openings the ambient air can be drawn into the housing interior of the jet regulator housing. This ambient air is then mixed with the water coming from the jet splitter in a mixing zone arranged on the outflow side of the jet splitter.

In the exemplary embodiment illustrated here, however, the jet regulator 1 is in the form of a non-aerated jet regulator.

A comparison of FIGS. 2 and 4 makes it clear that on the outflow side of the insert parts 5 there is provided a respective central spacer 21, the outflow-side end face of which, which is preferably arranged approximately in a plane with the outflow-side end face 20 of the outer ring 14, rests on the grid structure of an insert part that follows in the flow direction or of a flow straightener 22 that follows in the flow direction. In this way, the grid structures 6 of the insert parts 5 are additionally supported, in particular when the grid structure 6 of these insert parts 5 has a comparatively thin and filigree form.

In the longitudinal section according to FIG. 2, it can be seen that the jet regulator 1 has the flow straightener 22 on its outflow side. This flow straightener has a multiplicity of guide openings 23, which have a greater longitudinal extent than the clear opening cross section. In these guide openings, the water swirled in the housing interior of the jet regulator housing 2 is aligned and homogenized again, so that the water emerging from the jet regulator 1 can emerge as a homogeneous and non-sputtering water jet.

The longitudinal section according to FIG. 2 also shows that a flow rate regulator 24 is inserted in the cup interior of the cup-shaped diffuser insert 15. This flow rate regulator regulates the flow rate output to a specified value independently of the pressure. For this purpose, the flow rate regulator 24 has an annular throttle body 25 which delimits a control gap 26 between itself and at least one regulating profile provided on an opposite, inner or outer circumferential wall. Under the pressure of the water flowing through, the throttle body 25 produced from elastic material can mold into the regulating profile in such a way that the control gap 26 of the flow rate regulator 24 narrows on the basis of the water pressure.

It is advantageous if the flattened portion 10 provided on the outflow-side webs 8 constitutes a third of the radius of the overall approximately circular profile shape of these webs 8. It has been shown that, in the case of flattened portions 10 which are arranged on a larger radius, undesired excessive sputtering of the outflowing water can be possible. By contrast, in the case of the flattened portions 10 arranged at a smaller radial distance from the center of the webs 8, there is no appreciable improvement but rather additional mechanical weakening of the grid structure 6 is to be expected.

As disclosed by the exemplary embodiment shown here, two insert parts 5 are preferably arranged directly one behind the other in the flow direction. In this respect, it is not necessary to align the grid structures 6 of these insert parts 5 in relation to one another or in relation to the jet regulator housing 3. Since the grid structures 6 of the insert parts 5 are kept spaced apart by the outer ring 14 of these insert parts, between the grid structures 6 of these insert parts 5 there is formed a free space which allows the water passing through the inflow-side grid structure to expand and this water flowing through can therefore become steadied so as to form a good jet pattern.

LIST OF REFERENCE SIGNS

1 Jet regulator
2 Jet regulator housing
3 Jet splitter
5 Insert part
6 Grid structure
7 Webs in the inflow-side web set
8 Webs in the outflow-side web set
9 Crossing nodes
10 Flattened portion
11 Outflow side
12 Web wall
13 Web wall
14 Outer ring
15 Diffuser insert
16 Impinging surface
17 Splitter opening
18 Annular gap
19 Diffuser ring
20 Outflow-side end edge
21 Spacer
22 Flow straightener
23 Guide openings
24 Flow rate regulator
25 Throttle body made of elastic material
26 Control gap
Pf1 Throughflow direction

The invention claimed is:

1. A jet regulator (1) which can be mounted on a water outlet of a sanitary outlet fitting, the jet regulator comprising:

a jet regulator housing (2);

a jet splitter (3), which has splitter openings (17) for dividing the water flowing through into individual jets, located in the jet regulator housing;

at least one insert part (5) which has a grid structure (6) comprising two sets of parallel webs (7; 8) that touch or intersect one another at crossing nodes (9); wherein the two sets of parallel webs are arranged in two planes offset in a longitudinal direction of the jet regulator, the two sets of parallel webs (7; 8) comprise an inflow-side set of parallel webs (7) and an outflow-side set of parallel webs (8), each of the inflow-side set of parallel webs (7) has a round or rounded web cross section, and each of the outflow-side set of parallel webs (8) bears a flattened portion (10) on an inflow side thereof and is rounded on an outflow side (11) thereof, wherein the webs (7, 8) that cross one another are connected to one another in one piece, and the webs (7, 8) touch one another at the crossing nodes (9) such that the flattened portion (10) of the webs (8) provided in the outflow-side set is arranged approximately in a longitudinal center plane of the webs (7) forming the inflow-side set.

2. The jet regulator (1) as claimed in claim 1 wherein, the flattened portions (10) of the webs (8) provided in the outflow-side set and the rounded outflow sides (11) thereof are connected by web walls (12, 13) arranged parallel to one another in a throughflow direction (Pf1).

3. The jet regulator (1) as claimed in claim 2, the flattened portion (10) of the webs (8) provided in the outflow-side set form a respective right angle with the web walls (12, 13) adjoining either side thereof.

4. The jet regulator (1) as claimed in claim 2, wherein the web walls (12, 13) have a longitudinal extent in the throughflow direction that is greater than diameter of the rounding provided on the outflow side (11).

5. The jet regulator (1) as claimed in claim 1, wherein the grid structure (6) of the at least one insert part (5) is bounded by an outer ring (14), and web ends of the webs (7, 8) forming the grid structure (6) are molded on an inner circumference of the outer ring (14).

6. The jet regulator (1) as claimed in claim 1, wherein the at least one insert part (5) is a plastic injection-molded part.

7. The jet regulator (1) as claimed in claim 6, wherein the flattened portion (10) of the webs (8) provided in the outflow-side set are configured to define a tool parting plane of an injection molding tool used to produce the at least one insert part (5).

8. The jet regulator (1) as claimed in claim 1, wherein at least two of said insert parts (5) are connected downstream of the jet splitter (3) in a throughflow direction.

9. The jet regulator (1) as claimed in claim 1, wherein the jet splitter (3) comprises a diffuser which has a cup-shaped diffuser insert (15), a cup base of which forms an impinging and deflecting surface (16) for the inflowing water and which, on a circumferential wall of the cup shape, has the splitter openings (17) which are spaced apart from one another in a circumferential direction and lead into an annular gap (18).

10. The jet regulator (1) as claimed in claim 9, wherein the annular gap (18) narrows in the throughflow direction.

11. The jet regulator (1) as claimed in claim 9, wherein the diffuser insert (15) of the jet splitter (13) is insertable into a diffuser ring (19), and the annular gap (18) is formed between the diffuser insert (15) and the diffuser ring (19) of the diffuser.

12. The jet regulator (1) as claimed in 5, wherein an outflow-side end edge on the outer ring (14) of the at least one insert part (5) is arranged below a plane formed by the grid structure (6) in the throughflow direction (Pf1).

13. The jet regulator (1) as claimed in claim 1, wherein the jet regulator is an aerated jet regulator (1).

14. The jet regulator (1) as claimed in claim 5, wherein on the outflow side of the at least one insert part (5) there is provided a central spacer (21) having an outflow-side end face which is arranged approximately in a plane with an outflow-side end face (20) of the outer ring (14), and rests on the grid structure (6) of one said insert part (5) that follows in the flow direction or of an outflow-side flow straightener (22).

15. A jet regulator (1) which (1) can be mounted on a water outlet of a sanitary outlet fitting, the jet regulator comprising:

a jet regulator housing (2);

a jet splitter (3), which has splitter openings (17) for dividing the water flowing through into individual jets, located in the jet regulator housing;

at least one insert part (5) which has a grid structure (6) comprising two sets of parallel webs (7; 8) that touch or intersect one another at crossing nodes (9); wherein the two sets of parallel webs are arranged in two planes offset in a longitudinal direction of the jet regulator, the two sets of parallel webs (7; 8) comprise an inflow-side set of parallel webs (7) and an outflow-side set of parallel webs (8), each of the inflow-side set of parallel webs (7) has a round or rounded web cross section, and each of the outflow-side set of parallel webs (8) bears a flattened portion (10) on an inflow side thereof and is rounded on an outflow side (11) thereof, wherein the grid structure (6) of the at least one insert part (5) is bounded by an outer ring (14), and web ends of the webs (7, 8) forming the grid structure (6) are molded on an inner circumference of the outer ring (14), wherein on the outflow side of the at least one insert part (5) there is provided a central spacer (21) having an outflow-side end face which is arranged approximately in a plane with an outflow-side end face (20) of the outer ring (14), and rests on the grid structure (6) of one said insert part (5) that follows in the flow direction or of an outflow-side flow straightener (22).

16. The jet regulator (1) as claimed in claim 15, wherein the flattened portions (10) of the webs (8) provided in the outflow-side set and the rounded outflow sides (11) thereof are connected by web walls (12, 13) arranged parallel to one another in a throughflow direction (Pf1).

17. The jet regulator (1) as claimed in claim 16, the flattened portion (10) of the webs (8) provided in the outflow-side set form a respective right angle with the web walls (12, 13) adjoining either side thereof.

18. The jet regulator (1) as claimed in claim 16, wherein the web walls (12, 13) have a longitudinal extent in the throughflow direction that is greater than diameter of the rounding provided on the outflow side (11).

19. A jet regulator which can be mounted on a water outlet of a sanitary outlet fitting, the jet regulator comprising:

a jet regulator housing;

a jet splitter, which has splitter openings for dividing the water flowing through into individual jets, located in the jet regulator housing;

at least one insert part which has a grid structure comprising two sets of parallel webs that touch or intersect one another at crossing nodes; wherein the two sets of parallel webs are arranged in two planes offset in a longitudinal direction of the jet regulator, the two sets of parallel webs comprise an inflow-side set of parallel webs and an outflow-side set of parallel webs, each of the inflow-side set of parallel webs has a round or rounded web cross section, and each of the outflow-side set of parallel webs bears a flattened portion on an inflow side thereof and is rounded on an outflow side thereof, wherein, the flattened portions of the webs provided in the outflow-side set and the rounded outflow sides thereof are connected by web walls arranged parallel to one another in a throughflow direction, the flattened portion of the webs provided in the outflow-side set form a respective right angle with the web walls adjoining either side thereof.

* * * * *